US005190234A

United States Patent [19]

Ezekiel

[11] Patent Number: 5,190,234

[45] Date of Patent: Mar. 2, 1993

[54] WEB HANDLING METHOD AND APPARATUS WITH PRE-ACCELERATION OF WEB FEED ROLLS

[75] Inventor: Frederick D. Ezekiel, Lexington, Mass.

[73] Assignee: Butler Automatic, Inc., Canton, Mass.

[21] Appl. No.: 826,124

[22] Filed: Jan. 27, 1992

Related U.S. Application Data

[63] Continuation of Ser. No. 573,283, Aug. 24, 1990, abandoned, which is a continuation of Ser. No. 280,335, Dec. 6, 1988, abandoned.

[51] Int. Cl.[5] ..... B65H 19/14

[52] U.S. Cl. ..... 242/58.1; 242/58.4; 156/502; 156/504; 156/157

[58] Field of Search ..... 242/58.1, 58.2, 58.4; 156/157, 502, 504, 510

[56] References Cited

U.S. PATENT DOCUMENTS

| | | | |
|---|---|---|---|
| 3,813,053 | 5/1974 | Butler, Jr. et al. | 242/58.4 |
| 3,822,838 | 7/1974 | Butler, Jr. et al. | 242/75.44 |
| 3,896,820 | 7/1975 | Ludszeweit et al. | 131/21 R |
| 3,990,647 | 11/1976 | Clifford | 242/58.1 |
| 4,131,501 | 12/1978 | Böttcher et al. | 156/504 X |
| 4,188,257 | 2/1980 | Kirkpatrick | 156/504 |
| 4,281,803 | 8/1981 | Massey | 242/58.1 |
| 4,374,576 | 2/1983 | Ryan | 242/58.4 |
| 4,390,388 | 6/1983 | Nagata et al. | 156/504 X |
| 4,460,430 | 7/1984 | Kissell et al. | 156/504 |
| 4,543,149 | 9/1985 | Abe et al. | 156/350 |
| 4,543,152 | 9/1985 | Nozaka | 156/502 |
| 4,722,489 | 2/1988 | Wommer | 242/58.4 |

FOREIGN PATENT DOCUMENTS 60-67352 4/1985 Japan .

*Primary Examiner*—John M. Jillions
*Assistant Examiner*—Paul T. Bowen
*Attorney, Agent, or Firm*—Mark J. Patterson; Edward D. Lanquist, Jr.; I. C. Waddey, Jr.

[57] ABSTRACT

In a web handling apparatus for continuously supplying a running web to a web-consuming machine using a main accumulator to provide uninterrupted feed of the web during splicing of the trailing end of an expiring roll to the leading end of a ready roll, an improved ready-roll acceleration technique uses a supplemental accumulator disposed between the ready roll and the splicing head to enable the ready roll to be accelerated prior to completion of the splice. This technique permits the use of a smaller main accumulator and/or increased running speeds. In fact, the total storage capacity of the main and supplemental accumulators can be less than that of the single accumulator of conventional apparatus of this type. Furthermore, the running roll can be slowed without adverse consequence so as to reduce web tension upsets. The invention is also useful in web winder/splicer applications.

14 Claims, 3 Drawing Sheets

WEB HANDLING METHOD AND APPARATUS WITH PRE-ACCELERATION OF WEB FEED ROLLS

This application is a continuation of application Ser. No. 07/280,335, filed on Dec. 6, 1988, now abandoned, which is a continuation of application Ser. No. 07/573,283, filed on Aug. 24, 1990, now abandoned.

FIELD OF THE INVENTION

This invention relates to the field of web handling techniques, and more particularly to a method and apparatus for splicing together, at a selected minimum speed, including zero speed, ends of stationary and running webs of material, and for accelerating the stationary web to the velocity of the other web.

BACKGROUND OF THE INVENTION

In many manufacturing operations, the most efficient utilization of raw materials and equipment requires the continuous feed of a moving web of flat stock, for example, rolled paper, cardboard, floor covering and the like. To provide the web continuously, an apparatus is used to automatically splice the trailing end of an expiring roll of web material being utilized in the production process with the leading end of a fresh, replacement roll to be utilized next in the process. This is performed without interruption of the advance of the web or, for that matter, interruption of the manufacturing process itself. An implementation of a conventional apparatus of this type is taught by commonly-assigned U.S. Pat. No. 3,822,838, issued Jul. 9, 1974 and entitled "Web Handling Apparatus", the disclosure of which being incorporated herein by reference.

Basically, this conventional apparatus includes supports for a pair of web rolls, one of which is a running supply roll and one of which is a fresh roll at the ready for use next, after the running roll is depleted. The supports alternate in holding the running and ready rolls. Web is fed from the running roll, through a splicing mechanism, to an accumulator and then to a printing press or other machine which consumes the web at high speed. To assure a high quality, dependable splice, the splicing is carried out while the two webs being spliced are moving at a slow speed or are stationary. For this reason, it is commonly referred to as a "zero-speed" splice.

The web is pulled from the running supply roll by a mechanism in the web-consuming machine so that it usually moves at a constant rate whose value depends on the requirements or capabilities of the machine.

The accumulator shown in the previously-mentioned patent stores in festoon fashion an excess length of the material until such time as it is desired to make a splice. Then, during splicing, it gradually delivers the stored web to the web-consuming machine. Essentially, the accumulator is a mechanically adjustable, tortuous web path typically defined by a set of stationary rolls, each pair of which being separated along the web path by a movable roll. In other words, the web is looped between the fixed rolls and movable rolls, forming a series of bights.

The movable rolls are commonly referred to as a "dancer" and, in operation, translate in unison toward or away from the set of fixed rolls. This movement controls the amount of material in the accumulator. For example, as the dancer moves further away from the set of fixed rolls, the amount of material in the accumulator increases, and vice-versa. Typically, the dancer is biased away from the fixed rolls by a constant force, and is caused to move from a reference position by changes in tension in the web. In response to the deviation of the dancer from the reference position, the running supply roll is braked to a greater or lesser degree in a controlled fashion to return the dancer to its reference position and thus maintain the web tension within a selected range.

When it is time to initiate a splice, the splicing mechanism is actuated. In a typical instance, the ensuing splicing procedure entails several coordinated steps performed in sequence, including: stopping the rotation of the running supply roll, pressing the stationary web from that roll against the prepared leading end of the web from the fresh supply roll to make the splice, cutting the expiring web behind the splice and, finally, accelerating the fresh supply roll to bring the new web from that roll up to line speed and to replenish the accumulator. Conventionally, only after the splice is made is acceleration of the fresh roll commenced to bring the new web up to line speed.

To permit the two rolls to remain stationary during splicing without concomitantly interrupting the operation of the web-consuming apparatus, the storage capacity of the accumulator must be sufficient to meet the needs of the web-consuming apparatus during the entire splicing procedure. Of course, this means that the required accumulator storage capacity depends on the speed of travel of the web into the web-consuming apparatus. For instance, if a particular web-consuming machine has a line speed twice that of another such apparatus, twice as much web is used by the first web-consuming machine during the splicing procedure, and the accumulator of that machine must be able to store twice as much web.

By the same token, the required storage capacity of the accumulator also is dependent on the time it takes to accelerate the full roll from an angular velocity of zero to the selected running speed. It is self-evident that, until the fresh roll has reached the requisite speed, the accumulator must continue to make-up the resulting shortfall of web required by the web-consuming apparatus. The longer the acceleration takes, the larger must be the storage capacity of the accumulator. To shorten the duration of this acceleration phase of the splice sequence, some splicers incorporate a supplemental motor drive or "kicker" to overcome the inertia of the fresh roll and more quickly accelerate it to the requisite speed.

As is well known to those skilled in this art, most conventional web handling apparatus using such accumulator and roll acceleration arrangements do generally fulfill their intended purposes. However, their accumulators are large and occupy a considerable amount of floor space which is at a premium in most press rooms. Also, being composed of massive parts, they are relatively costly in their own right. Finally, because of the high inertias of their heavy moving parts, they tend to introduce tension upsets in the running web at the very high line speeds desired for present day presses, i.e., in excess of 2000 feet per minute.

As should be apparent from the foregoing discussion, the main disadvantages of prior web handling arrangements stem primarily from the length of time required to complete the entire zero-speed splice procedure including accelerating the fresh web to line speed. If normal operation at full line speed could be restored more quickly after the splice is made by, for example, finding a way to accelerate the fresh roll to line speed earlier, the accumulator size could be reduced or the line speed could be increased.

SUMMARY OF THE INVENTION

Accordingly, the invention aims to provide a web handling method and apparatus with an improved technique for accelerating a web to line speed.

Another object of the invention is to provide a web splicing apparatus having an improved web in-feed arrangement which is capable of accelerating the full roll prior to making the zero-speed splice, and accumulating the uncoiling web from that roll until the splice is completed.

Yet another object of the invention is to provide an improved web handling apparatus incorporating web accumulating means characterized by a smaller total web storage capacity for a given line speed of web into the web-consuming machine, or an increased line speed for a given storage capacity, as compared with conventional apparatus.

Other objects of the invention will in part be obvious and will in part appear hereinafter.

Briefly, a web splicing apparatus embodying the present invention is designed similar to the prior art apparatus described above, except that a smaller, supplemental or secondary accumulator is placed along the web path between each fresh roll to be accelerated and the splicing head. The supplemental accumulator takes-up slack in the web which results from accelerating the fresh roll before completion of the splice—while the leading end of that web is held stationary in the splicing mechanism of the splicing head. Such acceleration can be called pre-acceleration.

In other words, whereas conventionally the fresh roll is accelerated only after a splice has been made, in this improved apparatus the new roll is accelerated simultaneously with or even prior to splicing of the trailing end of the expiring web to the leading end of the fresh web. The excess web produced by this early acceleration is stored in the supplemental accumulator until after the splice has been made. At that instant, web from the supplemental accumulator is used to supply the main accumulator until the supplemental accumulator is depleted and all the while, the main accumulator supplies the web requirements of the web consuming machine until the new web reaches line speed. Actually, the web accelerates to a somewhat higher speed so that the main accumulator is replenished with web in preparation for the next splice cycle.

With this improved web-handling apparatus using pre-acceleration of the ready roll, the duration of the splicing procedure is reduced and thus less web needs to be supplied from the main accumulator during the splicing cycle. Not only does this permit the use of a main accumulator of a smaller size, but also the total storage capacity of the main and supplemental accumulators can be smaller than that of the single accumulator of conventional web handling apparatus described above. Alternatively, the line speed of the web-consuming machine can be increased or a combination of these advantages can be realized.

In addition to the reduction of storage capacity or alternatively increasing the web speed, the designer may carefully choose the optimum time intervals associated with the various stages of the splice procedure in order to minimize the web tension upsets associated with the splicing operation. For instance, the braking time of the expiring roll can be increased slightly in order to reduce the tension upset due to sudden brake application.

The invention is also useful in web winder/splicer applications.

The invention accordingly comprises the features of construction, combination of elements, and arrangement of parts which are exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

DESCRIPTION OF THE PREFERRED EMBODIMENT

Figure 1:
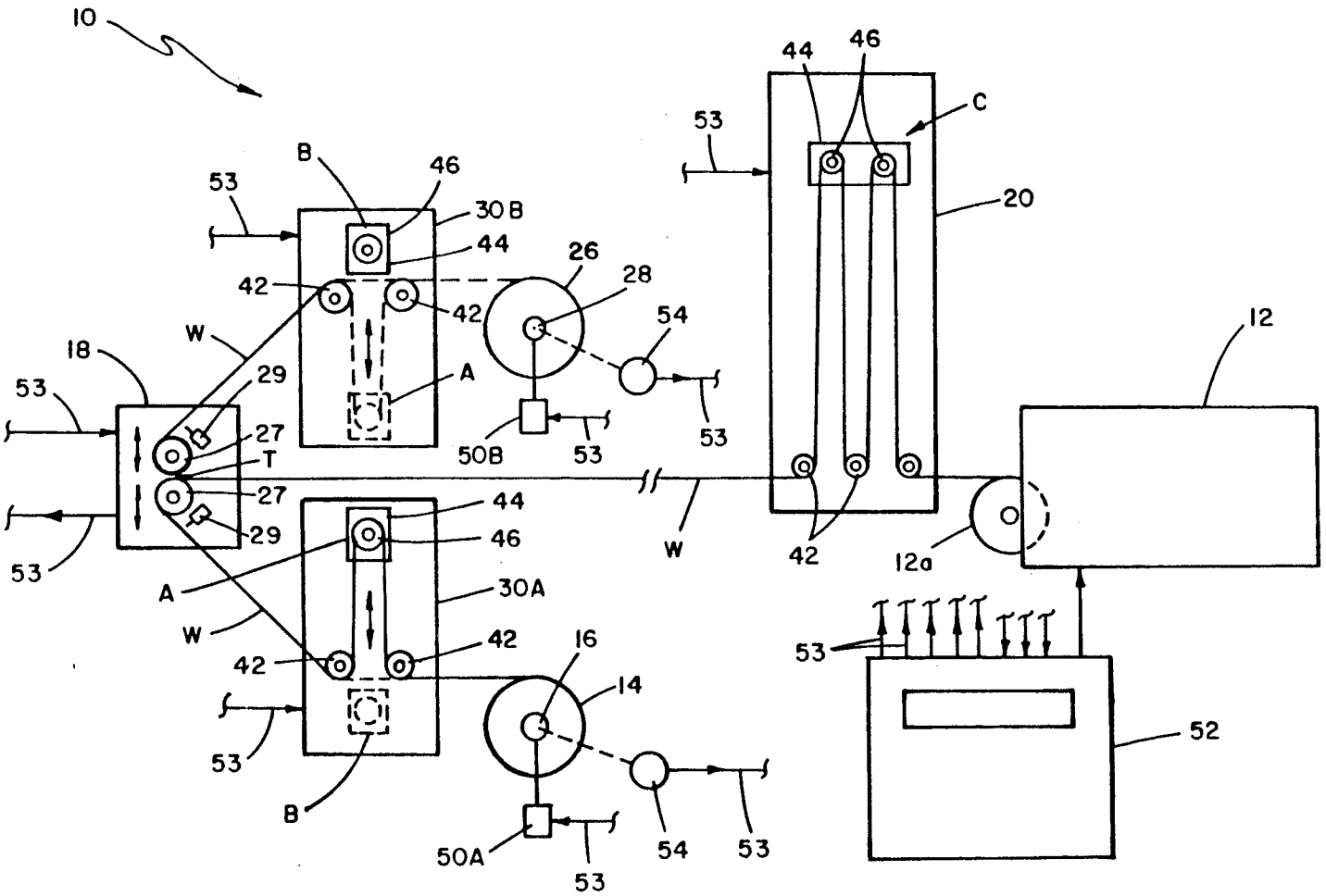
FIG. 1 is a representation, partially in block diagram form, of a web handling apparatus having supplemental accumulators to enable pre-acceleration of the fresh roll in accordance with the invention.

Turning now to FIG. 1 of the drawings, there is shown a web handling apparatus 10 for supplying a web W to a web-consuming machine 12, such as a printing press. A roll 14 of running web is supported for rotation on a suitable shaft or arbors 16. The web W from roll 14 is conducted through a splicing station 18 to a main accumulator shown generally at 20. The web leaving the accumulator 20 is conducted to the web-consuming machine 12. During normal operation, a pull roll or other mechanism **12*a* in machine 12** pulls web W with a constant force which is sufficient to give web W a usually constant, pre-determined speed into the press.

The apparatus 10 also includes a roll 26 of ready web W' also rotatively supported on a suitable shaft or arbors 28. The leading end of the web W' from roll 26 is prepared with double-faced tape T and set on one of a pair of spaced rolls 27 in the splicing head or station 18 in a conventional fashion to await the depletion of the running roll 14. When the roll 14 is nearly expired, the web W from that roll is spliced to the leading end of the web W' from roll 26 by bringing together the two rolls 27 and cutting the running web W behind the splice by activating a knife 29 so that web (now being drawn from roll 26) proceeds uninterruptedly through the main accumulator 20 into the web-consuming machine 12.

In operation, arbors 16 and 28 alternate in holding the running roll and ready roll. For instance, after the running roll 14 expires, the ready roll 26 is used as the feed to the web-consuming machine 12 and a fresh roll is readied on shaft or arbors 16. This process continues in alternation to assure an uninterrupted supply of web to the web-consuming machine 12.

In accordance with the invention, between the roll 14 and the web splicing head 18 along the web path is a first supplemental accumulator 30A, and similarly between the roll 26 and the web splicing head 18 is a second supplemental accumulator 30B. The function of these supplemental accumulators 30A and 30B will be explained shortly.

Each of the accumulators 20, 30A and 30B is of the same general construction, and so the same reference numbers will be used for the analogous component parts, but of course the supplemental accumulators are much smaller than the main accumulator. The accumulators 20, 30A and 30B each have a set of stationary rolls 42 and a dancer 44 in the form of a set of movable rolls 46 situated directly above rolls 42. The rolls 42 and 46 are staggered so that the web W can be looped around the rolls in festoon fashion, enabling an appreciable length of web to be stored by the accumulator 20, 30A, or 30B commensurate with the size of that accumulator. In other words, the amount of web stored in this manner depends upon the distance between the dancer 44 and the set of fixed rolls 42. As the spacing therebetween increases, more web is stored in the accumulator 20, 30A, or 30B, and vice versa. Thus the maximum storage capacity depends on the number of rolls 42 and 46 in the accumulator 20, 30A or 30B, and the maximum distance between the rolls 42 and 46. The design, construction, and operation of web accumulators is generally well known to those skilled in the art.

During taking-up of web to be stored in the accumulators 20, 30A or 30B, the dancer 44 is moved from its lowermost position adjacent the fixed rolls 42 whereat no or minimal web is stored in the accumulator 20, 30A, or 30B to an upper, reference position whereat the accumulator 20, 30A or 30B stores a selected high percentage (e.g., 80%) of its maximum storage capacity. (The reference position of dancer roll 46 of supplemental accumulator 30A is shown in solid lines at A, while its no-web-storage position is shown in phantom lines at B. On the other hand, the reference position of dancer roll 46 of supplemental accumulator 30B is shown in phantom at A, while its no-web-storage position is shown in solid lines at B.)

The main accumulator 20 is normally maintained at near full capacity and stores enough web when its dancer 44 is in its reference position shown by arrow C to supply the needs of the web-consuming machine 12 during the splicing procedure and yet accommodate or compensate for web tension upsets encountered during normal operation that cause its dancer 44 to move further away from the stationary rolls 42 and towards its maximum storage position.

The web-consuming machine 12 pulls the web W with a force sufficient to maintain a constant speed of travel of the running web, i.e., web W. Brakes 50A and 50B on shafts or arbors 16 and 28, in conjunction with a servo arrangement which responds to displacement of the main accumulator dancer 44 from its reference position, maintain the angular speed of the respective rolls 14 and 26 with which they are operatively associated despite changing conditions which would otherwise vary the web speed, including tension upsets and decreasing rotational inertia due to shrinking of the running roll 14 as web is consumed therefrom. With a constant web running speed, and absent a web tension upset, the dancer 44 of the main accumulator 20 remains substantially at the same distance from the stationary rolls 42, i.e., at position C. Furthermore, with a constant web running speed during normal operation, the web supplied from the running roll 14 to the main accumulator 20 is equal to the web delivered from the main accumulator to the web-consuming machine 12. Of course, this is not the case during splicing, as is described below.

A control unit or controller 52, which includes the servo circuitry described above and a computer, controls the positions of the dancers 44 of the accumulators 20, 30A and 30B, the actuation of the brakes 50A and 50B, and, in general, the actuation and timing of the web feeding and splicing operations. This involves the receipt of sensor signals and the transmission of control signals by the controller 52 over signal lines 53. The programming of the controller 52 and, in general, the generation of control signals in a feedback arrangement of the type illustrated and described herein, are well known in the art to which the invention pertains.

When the size of the running roll 14 reaches a predetermined minimum diameter, this is detected by a suitable sensor 54 which produces a signal that is processed by the controller 52. The controller 52 thereupon initiates the splicing procedure. In this regard, the controller 52 causes the brake 50A on the running roll 14 to be applied so that the roll 14 decelerates at a predetermined rate. As the running roll 14 slows, less and less web W is furnished to the main accumulator 20, and therefore it suffers a net depletion of its web as more web is delivered to the web-consuming machine 12 then is received from the supply roll 14.

As soon as the speed of the running web W reaches zero, i.e., a complete stop, or a selected minimum speed, the control unit 52 emits a control signal to the splicing head or station 18 to initiate the splice. For this, the rolls 27 at splicing station 18 are brought together to press the tape T at the leading edge of the ready web W, from roll 26 against the now stationary web W. The two webs now being spliced together, the control unit 52 actuates the knife 29 behind web W which cuts that web immediately behind the splice. In the prior art apparatus of this type, it is at this time that the full roll is accelerated to line speed, i.e., the speed of the web being consumed by the web-consuming machine.

In the present invention, the full roll 26 commences its acceleration at a selected point in time prior to the making of the splice, possibly even prior to full braking of the running roll 14 and, in any event, prior to the time that it is done conventionally. This can be termed "pre-acceleration." To do this, the control unit 52, at the appropriate time, emits a signal to a drive or kicker 54, for example a conventional eddy current motor drivingly associated with the shaft or arbors 28 supporting the ready roll 26. Drive 54 accelerates that roll 26 for a pre-determined time sufficient to bring the web from that roll up to line speed or to a higher speed until the main accumulator 20 is replenished with web to the desired 80% capacity. A similar drive 54 is associated with arbors 12 for accelerating a ready roll supported by those arbors.

We will now describe the operation of the supplemental accumulators 30A and 30B and their effect on the overall splice procedure. With the segment of web w in the splicing station 18 stationary (or at minimum speed) and roll 26 unwinding during the pre-acceleration period, the resulting slack in the ready web W' uncoiling from roll 26 is taken up and stored by the supplemental accumulator 30B. In other words, the excess web from roll 26 produced during pre-acceleration is accumulated in the supplemental accumulator 30B until the splice has been made by displacing that accumulator's dancer 44 toward its reference position B. Afterwards, the main accumulator 20 draws down accumulator 30B until the supplemental accumulator 30B is depleted, at which time web is drawn directly from the accelerated full roll 26. This is effected by moving the dancer 44 of the supplemental accumulator 30B at a controlled rate from its reference position A to its no-web-storage position B.

Similarly, supplemental accumulator 30A stores the excess web during pre-acceleration of a ready roll supported by arbors 16.

In essence, the provision of the supplemental accumulators 30A and 30B permits the pre-acceleration of the ready roll to take place. Because of this pre-acceleration, normal operation of the apparatus 10 is restored more quickly after the splice, and therefore the storage capacity of the main accumulator 20 of apparatus 10 can be reduced or the speed of the running web into machine 12 can be increased. Certain applications employing the present invention will benefit by utilizing both a main accumulator of reduced size and a faster web running speed.

Figure 2:
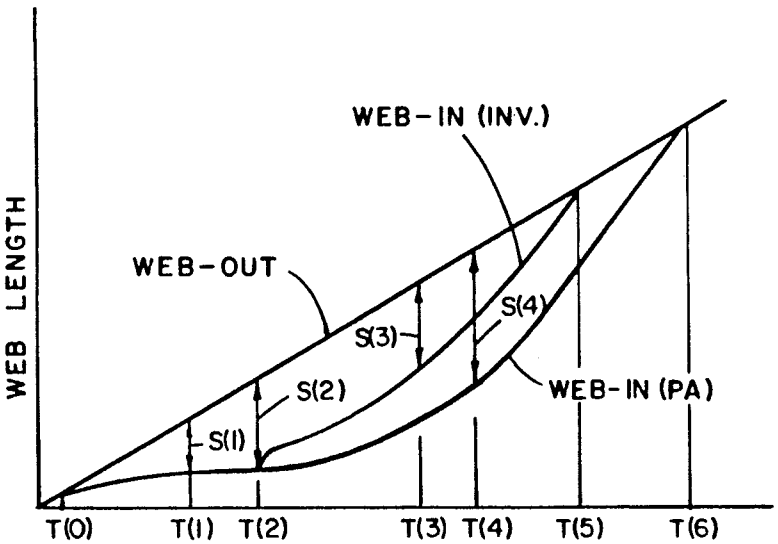
FIG. 2 is a graph in which accumulator web length is plotted against time for the FIG. 1 apparatus and for a prior art apparatus.

To understand the operation and advantages of apparatus 10 more fully, reference should be had to FIG. 2 which is a graph of web length plotted against time during a splice procedure—with curve WEB-IN (INV) representing the web length supplied to the main accumulator 20 of the improved apparatus 10, curve WEB-IN (PA) representing the web length supplied to the accumulator of the conventional apparatus, and curve WEB-OUT representing the web length depleted from either the main accumulator 20 of apparatus 10 of the present invention or the single accumulator of the conventional apparatus, the depletion rates of each for present purposes being constant and equal to one another. All of these curves are generated over both normal operation and during splicing.

With reference to FIG. 2, the uniformity of the running speed of the web into the web-consuming machine is illustrated by the linear, positively-sloped curve WEB-IN. This demand is met by web being delivered from the accumulator. Except for that period of operation when the splicing procedure is performed, the web lengths supplied to and delivered from the accumulator are equal and the length of web stored in that accumulator is generally constant (except as may result from web tension upsets). This is illustrated graphically by the curves WEB-IN (INV), WEB-IN (PA) and WEB-OUT being coincident and co-linear before the splicing procedure is commenced (i.e., before T-0) and then, again, after the splicing procedure is completed.

What happens during the splicing procedure is of considerably more interest. As the splicing sequence is initiated at time T-0, the expiring roll is slowed from its running speed and gradually brought to a complete stop at time T-1. The web length depleted from the accumulator 20 during slowing of the running roll is the difference between the curves WEB-IN (INV) or, for that matter, since the two are equal, between curves WEB-IN (PA) and WEB-OUT at time T-1, and this difference is designated S-1 in the graph. Once the expiring roll is stopped, the actual splicing operation begins. While splicing is being performed no web is being supplied to the accumulator 20. By the time the splice has been made and the web W cut behind the splice, that is, at time T-2, the total web length depleted from the accumulator 20 is S-2.

In the conventional apparatus represented by curve WEB-IN (PA), the fresh roll begins its acceleration at time T-2, and, in so doing, begins to supply web to the single accumulator. At a subsequent time T-4, the web into the accumulator is traveling at a speed equal to that of the outgoing web being fed to the web-consuming machine, and the accumulator realizes no net gain or loss of stored web. Graphically, this is illustrated by the slopes of the two curves WEB-IN (PA) and WEB-OUT being substantially equal at time T-4, i.e., a tangent through curve WEB-IN (PA) at time T-4 is parallel to the linear curve WEB-OUT. Also, the depletion of web in the accumulator at any time during the splice sequence is reflected by the difference between the curves WEB-OUT and WEB-IN (PA). The depletion designated S-4 at time T-4, represents the maximum length of web depleted during the splicing sequence. Beyond T-4, the web stored in the single accumulator of the conventional apparatus increases until the desired initial capacity is reached at T-6. Thus, the acceleration continues until the accumulator 20 is replenished and the fresh roll is at full running speed at time T-6.

Unlike the conventional apparatus, the improved apparatus 10 pre-accelerates the ready roll. This is reflected in the curve WEB-IN (INV) which represents the web length fed into the main accumulator 20 from the ready roll 26 beginning with its acceleration at time T-0 (time of deceleration) instead of T-2 (time of splice) as was the case for curve WEB-IN (PA). The effect to note is a sudden upward jump in the WEB-IN (INV) curve at time T-2, i.e., when the splice is made and the web length stored in the supplemental accumulator 30B is available to supply the main accumulator 20.

Before time T-2, the curves WEB-IN (INV) and WEB-IN (PA) are co-incident. Between time T-2 and the later time T-5 at which the fresh roll attains full running speed, curve WEB IN (INV) lies between the other two curves WEB-IN (PA) and WEB-OUT. As can be seen clearly in the graph of FIG. 2, the time T-3 at which the speeds of web into and out of the main accumulator are equal occurs for curve WEB-IN (INV) sooner than the corresponding time T-4 for curve WEB-IN (PA), and the value of the amount of web depleted at time T-3 (designated S-3) is smaller than the corresponding value S-4 for curve WEB-IN (PA). Furthermore, full running speed is attained earlier for apparatus 10 than for the conventional apparatus, that is, T-5 is less than T-6. This means that the main accumulator 20 of the improved apparatus 10 can be down-sized.

Correspondingly, if the fresh roll 26 were to start accelerating at a time prior to T-0, further reduction in the required storage capacity of the main accumulator 20 could be achieved. Of course, to do so, the supplemental accumulators 30A and 30B would have to be larger to accommodate the additional web length produced by the earlier acceleration and the greater speed of the fresh roll 26 attained by that acceleration before the supplemental accumulator 30A can yield up its stored web length to the main accumulator 20 after the splice is made.

Figure 3:
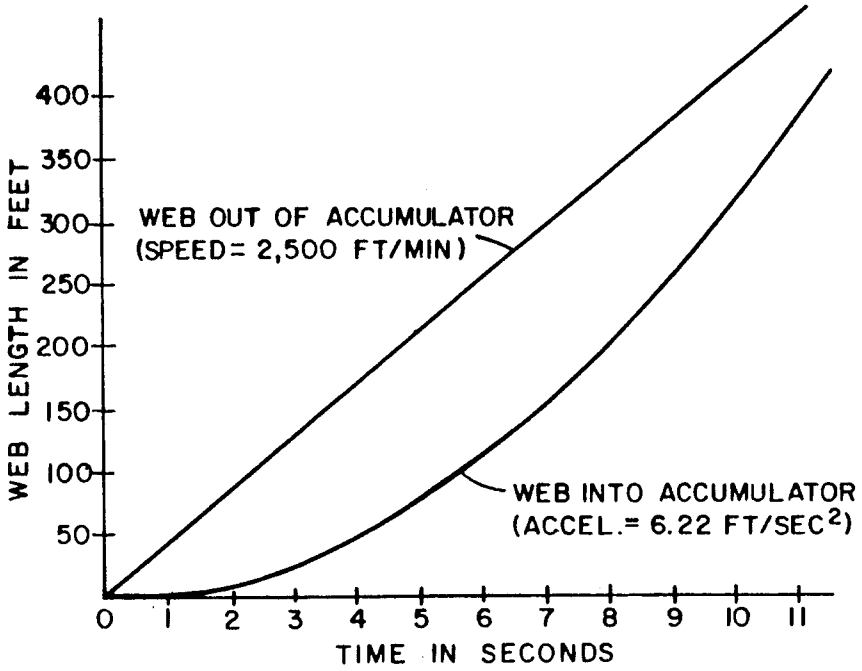
FIG. 3 is a graph in which the web length depleted from a running roll undergoing constant acceleration, and the web length depleted from the main accumulator at a constant running speed, are both plotted as functions of time.

To further illustrate the advantages of the present invention, FIG. 3 depicts the length of unwound web depleted from a roll undergoing constant acceleration of 6.22 feet per second squared as a function of time. Also shown is the length of web depleted from the main accumulator 20 at a constant running speed of 2,500 feet per minute. As can be seen, the length of web which is unwound from the roll during the initial few seconds is relatively small (e.g., under 50 feet in total) and hence can be readily accommodated with a small capacity supplemental accumulator. Furthermore, the length of time saved by pre-acceleration of even a few seconds permits a significant size reduction in the main accumulator 20 which needs to store 41.66 feet of web for each second of running time at the illustrated speed during the splicing procedure. Put in another way, a small supplemental accumulator 30A, 30B can yield a much larger storage reduction in the main accumulator 20.

This can be more fully appreciated from the following table which sets out the web storage requirements of the main accumulator 20 and the combined storage capacity of the supplemental accumulators 30A and 30B, as well as the total storage requirements of the apparatus 10, as a function of the pre-acceleration time (expressed as a period of seconds before or after the start of roll braking, though other reference times could have been utilized instead):

| ACCELERATION STARTING TIME (SECONDS) | MAIN ACCUMULATOR STORAGE (FEET) | COMBINED STORAGE OF SUPPLEMENTAL ACCUMULATORS (FEET) | TOTAL STORAGE OF APPARATUS 10 |
|---|---|---|---|
| +2 | 225 | 0 | 225 |
| +1 | 185 | 6.2 | 191.2 |
| 0 | 140 | 24.8 | 164.8 |
| −1 | 100 | 56 | 156 |
| −2 | 60 | 100 | 160 |

The values given in this table were generated specifically for the above-mentioned running speed and roll acceleration. The combined storage capacity of the supplemental accumulators 30A, 30B given in the table assumes that they are of equal size. Obviously, to obtain the capacity of either supplemental accumulator 30A or 30B, the combined capacity value simply is divided in half.

As can be seen in the first row of table entries, when the combined storage capacity of the supplemental accumulators is zero, the apparatus 10 effectively has only a single accumulator as in the conventional apparatus. With this the case, the acceleration starts just after the splice is made, i.e., at two seconds after the start of roll braking. The total storage capacity of apparatus 10 is equal to the storage capacity of the main accumulator 20, which is 225 feet.

The other rows of table entries reflect acceleration starting times occurring prior to splicing. The earlier the acceleration starting time, the larger must be the storage capacity of the supplemental accumulators 30A, 30B. Thus, for example, when the start of acceleration occurs simultaneous with the start of braking, i.e., at an acceleration starting time of zero in the table, the combined storage capacity of the supplemental accumulators 30A, 30B is 24.8 feet (12.4 feet each) and the main accumulator 20 is sized to hold 140 feet of web. This yields a total storage capacity for apparatus 10 of 164.8, which is over 60 feet less than the 225 feet required for the single accumulator of the conventional apparatus. This clearly illustrates the savings in storage requirements realized by the invention.

In addition to these advantages in accumulator storage requirements and web running speed, apparatus 10 can be designed to carry out the various splicing procedures at optimal time intervals to minimize web tension upsets associated with splicing operations of the conventional apparatus. For instance, the braking time of the expiring roll can be increased slightly in order to reduce the likelihood of a web tension upset due to the application of the brake to the running roll preparatory to splicing.

It will thus be seen that the objects set forth hereinabove, among those made apparent from the preceding description, are efficiently attained. Also, certain changes may be made in the above-described construction without departing from the scope of the invention.

Figure 4:
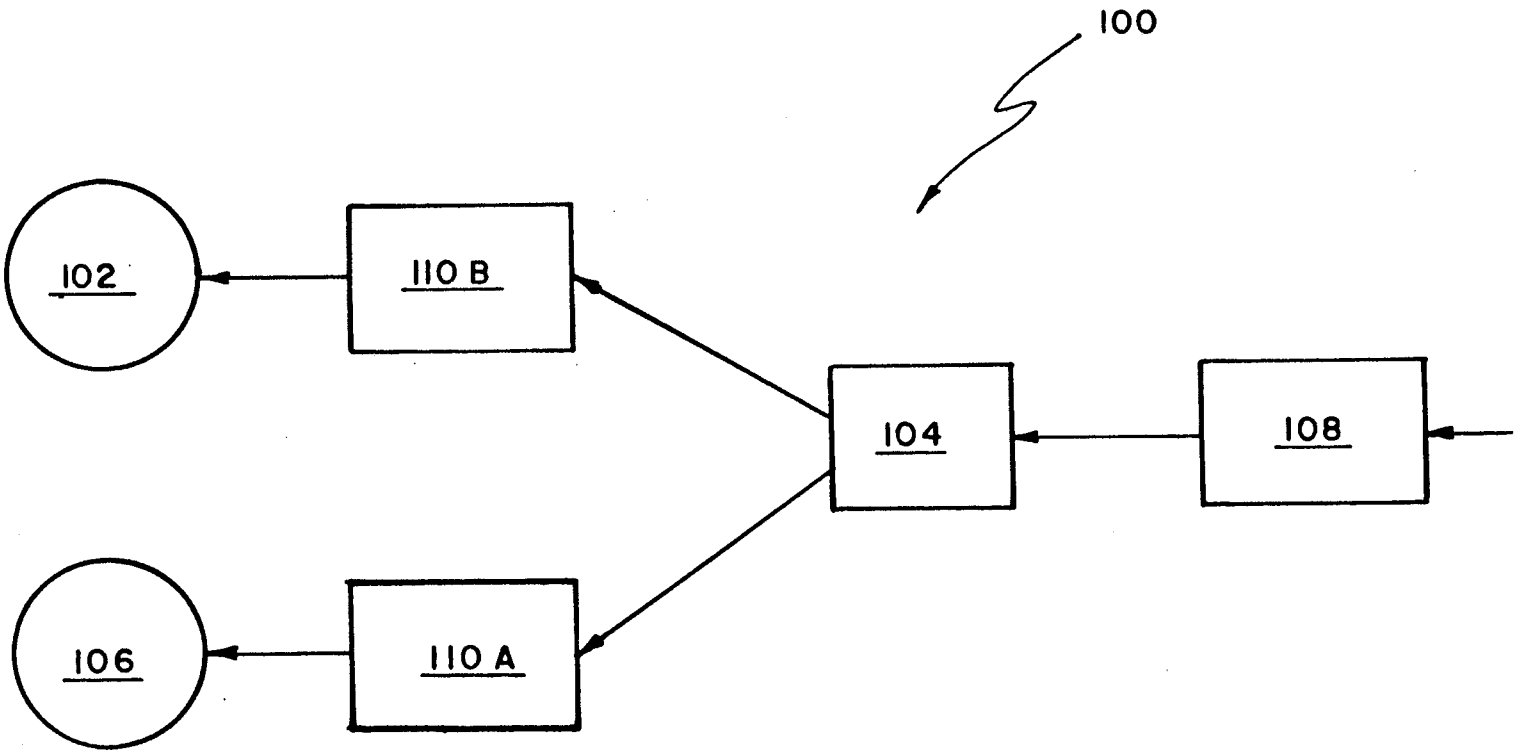
FIG. 4 is a representation in block diagram form of an improved winder/splicer in accordance with the invention.

For example, supplemental accumulators may be incorporated into a dual-roll web winder/splicer of the type disclosed in commonly-assigned U.S. Pat. No. 3,813,053, entitled "Web Winding Machines" (the disclosure of which being incorporated herein by reference). Such winding machines permit a length of web to be wound continuously onto a single roll. Such an improved winder/splicer 100 is illustrated in FIG. 4. As the winding web roll at a first winding station 102 becomes completely wound, the web is stopped or slowed so that a splice is formed by a splicing head 104 between the running web and a leader secured to an empty core at a second or alternate winding station 106. During splicing, web coming into the winder/splicer 100 is stored in a main accumulator 108. The main accumulator 108 is empty during normal operation and stores web entering the winder/splicer 100 during the splicing procedure.

Pre-acceleration of the empty core is made possible by the incorporation of a supplemental accumulator 110A interposed between the splicing head and the empty core. In this application, the supplemental accumulator 110A is normally maintained at near full capacity and is drawn down during the splice. Analogous to the web handling apparatus 10, a second supplemental accumulator 110B is provided along the web path between the first winding station 102 and the splicing head 104 to permit pre-acceleration when that winding station has the empty core.

Therefore, it is intended that all matter contained in the above description or shown in the accompanying drawings shall be interpreted as illustrative and not in a limiting sense. It is also to be understood that the following claims are intended to cover all of the generic and specific features of the invention herein described and those made obvious herefrom.

What is intended to be covered by Letters Patent is:

1. A web handling apparatus for continuously supplying a running web to a web-consuming machine at a first speed, and for splicing said running web to a ready web at a lower, second speed while continuing to supply said running web to said web-consuming machine at said first speed, said apparatus comprising:

A) first means for rotatably supporting a roll of running web for supplying web therefrom at said first speed;

B) second means for rotatably supporting a roll of ready web;

C) means for pulling said running web from said roll of running web with a substantially constant force sufficient to move said running web at said first speed;

D) means for braking the rotation of said roll of running web so as to slow a trailing end segment thereof to a selected minimum speed including zero;

E) means disposed along a web path between said first supporting means and said pulling means for splicing said slowed trailing end segment with a leading end of said ready web;

F) first storage means disposed along said web path between said splicing means and said pulling means for storing a length of said running web and for supplying said stored length at said first speed to a web-consuming machine while said braking means is slowing said roll of running web and said webs are being spliced at said minimum speed;

G) driver means coupled with said roll of ready web for accelerating said roll of ready web prior to completion of said splice during a pre-acceleration phase and for continuing said acceleration thereafter to said first speed, so as to be able to attain said first speed earlier than said first speed would be attained if said acceleration did not begin until said splice were completed; and H) second storage means disposed along a second web path between said roll of ready web and said splicing means for storing a length of said ready web while said roll of ready web is being accelerated before completion of said splice and attainment of said first speed by said ready web.

2. The web handling apparatus in accordance with claim 1, wherein said second storage means stores substantially no web immediately before acceleration of said ready web.

3. The web handling apparatus in accordance with claim 1, wherein said splicer splices said trailing end segment with said leading end while said minimum speed is zero.

4. The web handling apparatus in accordance with claim 1, wherein, for a period following a splice, said driver means accelerates the roll of ready web to a speed higher than said first speed so as to be able to replenish the web stored in said first storage means while supplying said ready web to said web-consuming machine at said first speed.

5. For continuously supplying web during both a normal operating period and a splicing period at a selected running speed to a web consuming machine, a web handling apparatus comprising:

A) a main accumulator;

B) splicing means;

C) a first web station including i) first means rotatably supporting a first web roll for unwinding web therefrom, ii) first supplemental accumulator for storing web unwound from said first web roll during said splicing period and for supplying web from said first web roll to said splicing means, and iii) first means coupled with said first supporting means for rotating said first web roll at predetermined speeds;

D) a second web station including i) second means rotatably supporting a second web roll for unwinding web therefrom, ii) second supplemental accumulator for storing web unwound from said second web roll during said splicing period, and for supplying web from said second web roll to said splicing means, and iii) second means coupled with said second supporting means for rotating said second web roll at pre-determined speeds;

E) means for pulling web from one of said first and second web rolls along a web path with a substantially constant force sufficient to move said running web at said first speed;

F) said splicing means being disposed along said web path between said first and second web stations and said pulling means, and being operable during said splicing period for splicing a trailing end of unwound web from one of said first and second web rolls with a leading end of unwound web from the other of said first and second web rolls, said splicing means making said splice while said unwound web from said one web roll travels at a selected minimum speed less than said running speed;

G) said main accumulator being disposed along said web path between said splicing means and said pulling means for storing a pre-selected length of web during said normal operating period and providing at least a portion of the web stored therein during said splicing period, so as to store a maximum length of web during said normal operating period and a minimum length of web during said splicing period;

H) wherein, i) during said normal operating period, web is supplied to said web consuming machine at said selected running speed from one of said first and second web rolls and, in order to substantially deplete the web stored therein, from the associated one of said first and second supplemental accumulators, and without depleting the web stored within said main accumulator, and ii) during said splicing period, web is supplied to said web-consuming machine at said selected running speed from said main accumulator; and I) means for causing the one of said first and second rotation means associated with the web roll providing the leading end of unwound web to the splicing means to begin accelerating that web roll prior to splicing and then continuing acceleration of that web roll to a speed in excess of the selected running speed in such manner as to attain the selected running speed earlier than would be the case if that web roll were not accelerated until the splice were made, and to replenish the web in said main accumulator in preparation for another splicing phase, wherein web that is unwound from said accelerating web roll prior to splicing is stored in the associated supplemental accumulator.

6. The web handling apparatus in accordance with claim 5, wherein said selected minimum speed is zero.

7. The web handling apparatus in accordance with claim 5, wherein said first and second supplemental accumulators store substantially no web during the normal operating period.

8. A web handling method for continuously supplying a running web to a web-consuming machine at a first speed and for splicing said running web to a ready web at a lower, second speed while continuing to supply said running web to said web-consuming machine at said first speed, said method comprising the steps of A) rotating a first roll of web, and supplying a leading end of said web at a selected running speed to a web-consuming machine;

B) storing a length of said web from said first roll in a first accumulator;

C) braking said first roll so as to slow a trailing end of said web to a selected minimum speed including zero;

D) splicing the slowed trailing end of said first roll to a leading end of web of a second roll while said first roll is rotating at said minimum speed;

E) during said braking and splicing steps, supplying at least a portion of said web stored in said first accumulator at said selected running speed to said web-consuming machine;

F) beginning acceleration of said web from said second web supply before completing said splicing step, and continuing said acceleration to said selected running speed;

G) storing, in a second accumulator, web unwound from said second web supply due to said acceleration; and H) after completion of said splice, supplying to said web-consuming machine said web stored in said second accumulator due to said acceleration.

9. While continuously supplying a web at a selected running speed to a web-consuming machine, a method of splicing a trailing end of web from a rotatably-supported first web roll to a leading end of web from a rotatably-supported second web roll at a selected minimum speed including zero, said method comprising the steps of:

A) rotating said first web roll so as to unwind web therefrom at said selected running speed;

B) passing said unwound web along a web path from said first web roll through a first web-storage means for storing a predetermined length of web and then to said web-consuming machine; said rotating step comprising the step of pulling the web from said first web roll by means disposed along said web path between said first web-storage means and said web-consuming machine;

C) supplying the unwound web from said first web roll at said selected running speed to said web-consuming machine while substantially maintaining the length of web stored in said first web-storage means during non-splicing operation;

D) braking the rotation of said first web roll so as to slow a trailing end of said unwound web therefrom to a selected minimum speed including zero;

E) at a splicing location along said web path between said first web roll and said first web-storage means, splicing said slowed trailing end of said unwound web from said first web roll with a leading end of said second web roll;

F) during said braking and splicing steps, supplying at least a portion of said web stored in said first storage means to said web-consuming machine so as to maintain the supply of web thereto at said selected running speed;

G) accelerating said second web roll so as to unwind web therefrom before completing said splicing step, and continuing said acceleration until web unwinding therefrom achieves a speed in excess of said selected running speed so as to be able to replenish the web in said first storage means and to supply web from said second web roll to said web-consuming machine at said selected running speed; and H) in a second storage means disposed along a second web path between said second web roll and said splicing location, storing at least a portion of web unwound from said second web supply due to said acceleration while said splice is being performed.

10. A method of splicing a first web, drawn from a rotatably supported running roll and feeding into a first web accumulator serving web to a web consuming machine running at a substantially constant line speed, to the adherent leading edge margin of a second web wound on a rotatably supported ready roll, said method comprising the steps of braking said running roll until the speed of the first web entering the accumulator slows to a selected splicing speed;

upon the first web reaching the selected speed, pressing together the leading edge margin of the second web and the first web ahead of the first web accumulator to splice the two webs;

while the two webs are still pressed together, accelerating the ready roll and storing the second web let off said ready roll in a second web accumulator;

severing the first web just behind the splice;

relieving the pressing of the webs;

continuing the acceleration of the ready roll after said relieving step until the second web attains a running speed at or near line speed, and subsequent to said relieving step substantially emptying the second web stored in the second web accumulator into the first web accumulator.

11. The method defined in claim 10 wherein said second web accumulator is emptied during said continuing acceleration of the ready roll.

12. The method defined in claim 10 including the step of forming the first accumulator with a substantially greater web storage capacity than the second web accumulator.

13. Splicing apparatus comprising a first web accumulator;

means for rotatably supporting a first roll of running web;

means for rotatably supporting a second roll of ready web, said ready web having an adherent leading end;

means for guiding said running web from said first roll through said first web accumulator;

means for drawing the running web from said first web accumulator at a substantially constant line speed;

means for braking said first roll until the running web entering the first web accumulator slows to a selected splicing speed;

means responsive to the attainment of said splicing speed for momentarily pressing the adherent leading end of the ready web and the running web together ahead of the first web accumulator to splice the two webs;

means for accelerating the second roll while the two webs are still pressed together;

a second web accumulator for storing the ready web let off the second roll while the two webs are pressed together;

a knife for severing the running web just behind the splice, and means for stopping the acceleration of the second roll when the web from that roll attains a selected speed at or near said line speed.

14. The apparatus defined in claim 13 wherein the first accumulator has a web storage capacity substantially greater than that of the second accumulator.

* * * * *